US007661695B2

(12) United States Patent
Miette

(10) Patent No.: US 7,661,695 B2
(45) Date of Patent: Feb. 16, 2010

(54) CROSS-COUNTRY SKI ASSEMBLY AND CROSS-COUNTRY SKI BINDING

(75) Inventor: Philippe Miette, Annecy le Vieux (FR)

(73) Assignee: Salomon S.A.S., Metz-Tessy (FR)

( * ) Notice: Subject to any disclaimer, the term of this patent is extended or adjusted under 35 U.S.C. 154(b) by 0 days.

(21) Appl. No.: 11/692,419

(22) Filed: Mar. 28, 2007

(65) Prior Publication Data

US 2007/0228695 A1 Oct. 4, 2007

(30) Foreign Application Priority Data

Mar. 29, 2006 (FR) ..... 06.02734

(51) Int. Cl.
*A63C 9/00* (2006.01)

(52) U.S. Cl. ..... 280/623; 280/611; 280/615; 280/633; 280/644

(58) Field of Classification Search ..... 280/615, 280/623, 611, 633, 634
See application file for complete search history.

(56) References Cited

U.S. PATENT DOCUMENTS

| | | | | |
|---|---|---|---|---|
| 3,514,119 | A * | 5/1970 | Sutherland | 280/617 |
| 4,907,817 | A * | 3/1990 | Schwarz | 280/615 |
| 5,052,710 | A | 10/1991 | Provence et al. | |
| 5,092,620 | A | 3/1992 | Girault et al. | |
| 5,114,172 | A | 5/1992 | Rousset et al. | |
| 5,338,053 | A | 8/1994 | Hauglin | |
| 5,671,941 | A | 9/1997 | Girard | |
| 5,794,963 | A | 8/1998 | Girard | |
| 5,924,719 | A | 7/1999 | Girard | |
| 5,957,478 | A | 9/1999 | Vigny | |
| 6,017,050 | A | 1/2000 | Girard | |
| 6,027,135 | A | 2/2000 | Hauglin | |
| 6,209,903 | B1 * | 4/2001 | Girard | 280/615 |
| 6,289,610 | B1 | 9/2001 | Girard et al. | |
| 6,374,517 | B2 | 4/2002 | Girard | |
| 6,435,537 | B2 * | 8/2002 | Veux | 280/615 |
| 6,644,683 | B1 | 11/2003 | Hauglin | |

(Continued)

FOREIGN PATENT DOCUMENTS

DE 3739419 A1 * 6/1989

(Continued)

OTHER PUBLICATIONS

U.S. Appl. No. 11/639,289, filed Dec. 15, 2006, Philippe Miette et al.

(Continued)

*Primary Examiner*—Lesley D Morris
*Assistant Examiner*—Katy Meyer
(74) *Attorney, Agent, or Firm*—Greenblum & Bernstein P.L.C.

(57) ABSTRACT

An assembly of a ski and a device for binding a boot to the ski, the assembly including a ski having an upper surface adapted to receive the binding device. The assembly includes an anchoring device that includes a slide and a binding device that includes a base, the base bearing a mechanism for locking the boot. The mechanism includes at least one movable member controlled by a manipulable member. The anchoring device includes at least one mechanism for tightening the binding device with respect to the ski, and the tightening mechanism is implemented by moving the manipulable member its open position to its closed position.

39 Claims, 6 Drawing Sheets

U.S. PATENT DOCUMENTS

| | | | | |
|---|---|---|---|---|
| 6,811,177 | B2 | 11/2004 | Lancon et al. | |
| 6,964,428 | B2 | 11/2005 | Quellais et al. | |
| 6,986,526 | B2 | 1/2006 | Haughlin | |
| 7,097,194 | B2 | 8/2006 | Kogler | |
| 7,111,865 | B2 | 9/2006 | Girard | |
| 2001/0002747 | A1 * | 6/2001 | Gignoux et al. | 280/615 |
| 2002/0105168 | A1 | 8/2002 | Lancon | |
| 2004/0056449 | A1 | 3/2004 | Girard et al. | |
| 2006/0012152 | A1 | 1/2006 | Quellais et al. | |
| 2006/0145452 | A1 | 7/2006 | Bjertnaes | |

FOREIGN PATENT DOCUMENTS

| | | | |
|---|---|---|---|
| DE | 297 24 094 | U1 | 1/2000 |
| DE | 10 2004 018 296 | A1 | 2/2005 |
| DE | 20 2005 002 010 | U1 | 6/2005 |
| DE | 10 2004 024 881 | A1 | 7/2005 |
| EP | 0 383 104 | A2 | 8/1990 |
| EP | 0 551 899 | A1 | 7/1993 |
| EP | 0 679 415 | A1 | 11/1995 |
| EP | 0 768 103 | A1 | 4/1997 |
| EP | 0 904 139 | B1 | 11/1998 |
| EP | 0 913 102 | A1 | 5/1999 |
| EP | 0 913 103 | A1 | 5/1999 |
| EP | 1 062 991 | A2 | 12/2000 |
| EP | 1 440 713 | A1 | 7/2004 |
| FR | 2 638 974 | A1 | 5/1990 |
| FR | 2 641 196 | A1 | 7/1990 |
| FR | 2 645 764 | A1 | 10/1990 |
| FR | 2 733 159 | A1 | 10/1996 |
| FR | 2 736 842 | A1 | 1/1997 |
| FR | 2 738 158 | A1 | 3/1997 |
| FR | 2 742 060 | A1 | 6/1997 |
| FR | 2 776 200 | A1 | 9/1999 |
| FR | 2 834 473 | A1 | 7/2003 |
| FR | 2 843 310 | A1 | 2/2004 |
| FR | 2 853 253 | A1 | 10/2004 |
| FR | 2 856 312 | A1 | 12/2004 |
| WO | WO-88/04563 | A1 | 6/1988 |
| WO | WO-98/37933 | A1 | 9/1998 |
| WO | WO-00/04965 | A1 | 2/2000 |
| WO | WO-01/93963 | A1 | 12/2001 |
| WO | WO-03/002217 | A2 | 1/2003 |
| WO | WO-03/084620 | A1 | 10/2003 |
| WO | WO-2004/045728 | A2 | 6/2004 |
| WO | WO-2006/072812 | A1 | 7/2006 |

OTHER PUBLICATIONS

U.S. Appl. No. 29/277,934, filed Mar. 14, 2007, Girard et al.

* cited by examiner

CROSS-COUNTRY SKI ASSEMBLY AND CROSS-COUNTRY SKI BINDING

CROSS-REFERENCE TO RELATED APPLICATION

This application claims priority under 35 U.S.C. §119 of French Patent Application No. 06 02734, filed on Mar. 29, 2006, the disclosure of which is hereby incorporated by reference thereto in its entirety.

BACKGROUND OF THE INVENTION

1. Field of the Invention

The invention relates to the field of cross-country skis provided with at least one device for binding an article of footwear to the ski.

2. Description of Background and Relevant Information

In many cross-country ski bindings, or ski binding devices, the connection means of the boot is in the form of a connector, such as a connecting rod or pin, adapted to be held in a latch or jaw associated with the ski. Examples of such mechanisms are disclosed in the following patent documents: FR-2638974, U.S. Pat. No. 5,052,710, FR-2645764, U.S. Pat. No. 5,092,620, FR-2834473, U.S. Pat. No. 6,811,177, FR-2742060, FR-2856312, U.S. Pat. No. 7,111,865, FR-2738158, U.S. Pat. No. 5,794,963, EP-551899, U.S. Pat. No. 5,338,053, EP-904139, and U.S. Pat. No. 6,027,135.

In other devices, the connection means of the boot is made in two parts, i.e., either two parallel connectors, i.e., rods or pins (EP-679415, U.S. Pat. No. 5,671,941, FR-2853253, FR-2843310, US-2004/0056449, WO-01/93963, U.S. Pat. No. 6,986,526), or a front stop and a rear engagement element (FR-2776200, U.S. Pat. No. 6,435,537, FR-2733159, U.S. Pat. No. 5,957,478, EP-1100601, WO-00/04965, U.S. Pat. No. 6,644,683, DE-102004018296).

Other structures are disclosed in the patent documents EP-1492598, WO-03/084620, and U.S. Pat. No. 7,097,194, for example.

Various arrangements are known for mounting such binding devices onto a cross-country ski. In numerous cases, the anchoring is provided simply by screws, which make it possible to fix the device directly to the ski. In other cases, the binding device is directly glued or welded to the ski, or even elastically nested onto the ski.

The patent document WO-88/04563 discloses a binding device for cross-country skis, which device is mounted on an interface element integrated with the ski. The interface element is provided with a longitudinal guide plate in which the binding device can slide. The binding device has a specific arrangement for blocking its longitudinal position with respect to the interface element. This arrangement includes a vertical screw, which penetrates the ski at the front, on the one hand, and an eccentric/off-centered toothed wheel cooperating with a lateral rack, on the other hand. The blocking arrangement disclosed in WO-88/04563, therefore, provides for the blocking of the device in any one of a plurality of predefined discrete positions.

The patent document WO-03/002217 discloses a binding device mounted to an interface element which is in the form of a plate covering the upper surface of the ski. The interface plate is screwed onto the ski and the binding device is mounted to the interface plate with no direct contact between the binding device and the ski.

The patent documents WO-2004/045728, US-2006/0145452, and DE-U-202005002010 disclose an interface plate adapted to be glued or welded to the ski. The edges of the plate form a guide onto which the body of the binding device can be slidably engaged.

The patent document DE-102004024881 discloses a binding device mounted on an interface element and having toothed rockers, which are part of the base of the binding and are provided to cooperate with corresponding racks formed on the interface element. This mechanism, like that of the aforementioned patent document WO-88/04563, ensures that the binding device is blocked in one of several predetermined discrete positions without providing for a tightening mechanism.

The patent document DE-U-29724094 discloses an assembly in which a central rail is fixed on the upper surface of a ski. A base, to which a binding device can be secured, has on its lower surface a profile that is complementary to the rail so as to be slidably engaged on the rail. A longitudinal blocking mechanism is provided to ensure the binding device is completely anchored to the ski. This document does not describe a tightening mechanism.

The prior art, according to which the binding devices are screwed directly into the ski, offer greater possibilities for mounting/dismounting the assembly, as well as possibilities for adjusting the longitudinal position on the ski. However, they have drawbacks such as adding weight to the assembly, increasing the height of the binding device relative to the ski, and/or preventing the skier's forces from being directly transmitted to the ski, as well as many factors that negatively affect the performance of the assembly. Furthermore, they all have the same drawback of allowing operational clearances, or play, between the binding device and the ski, which negatively affects the precise steering of the ski. Some prior art devices have actually shown that, as the longitudinal locking mechanisms have no retaining/guiding function, the binding device could separate from its interface in the case of a substantial force, such as during a fall.

SUMMARY OF THE INVENTION

The invention provides a new ski binding assembly, which makes it possible to achieve a better compromise among all of the aforementioned components.

To this end, the invention proposes a ski binding assembly for a ski having an upper surface adapted to receive a binding device provided to retain a boot on the ski, of the type in which the binding assembly has a device that anchors the binding device to the ski, the anchoring device including a slide, of the type in which the binding device comprises a base and a mechanism for locking the boot, the mechanism comprising at least one movable member controlled by a manipulable member that can be moved between an opening position and a closing position, the anchoring device having at least one mechanism for tightening the binding device with respect to the ski, the tightening mechanism being actuated by the movement of the manipulable member from the opening position to the closing position.

BRIEF DESCRIPTION OF DRAWINGS

Other characteristics and advantages of the invention will be better understood from the detailed description that follows, with reference to the annexed drawings, in which.

DETAILED DESCRIPTION OF THE INVENTION

Three exemplary embodiments of an assembly 10 according to the invention are more particularly described below. Such assembly, in each case, includes a cross-country ski binding device 12 that retains the front end of a cross-country ski boot, the rear end of which remains free to be raised and lowered.

Figure 2:
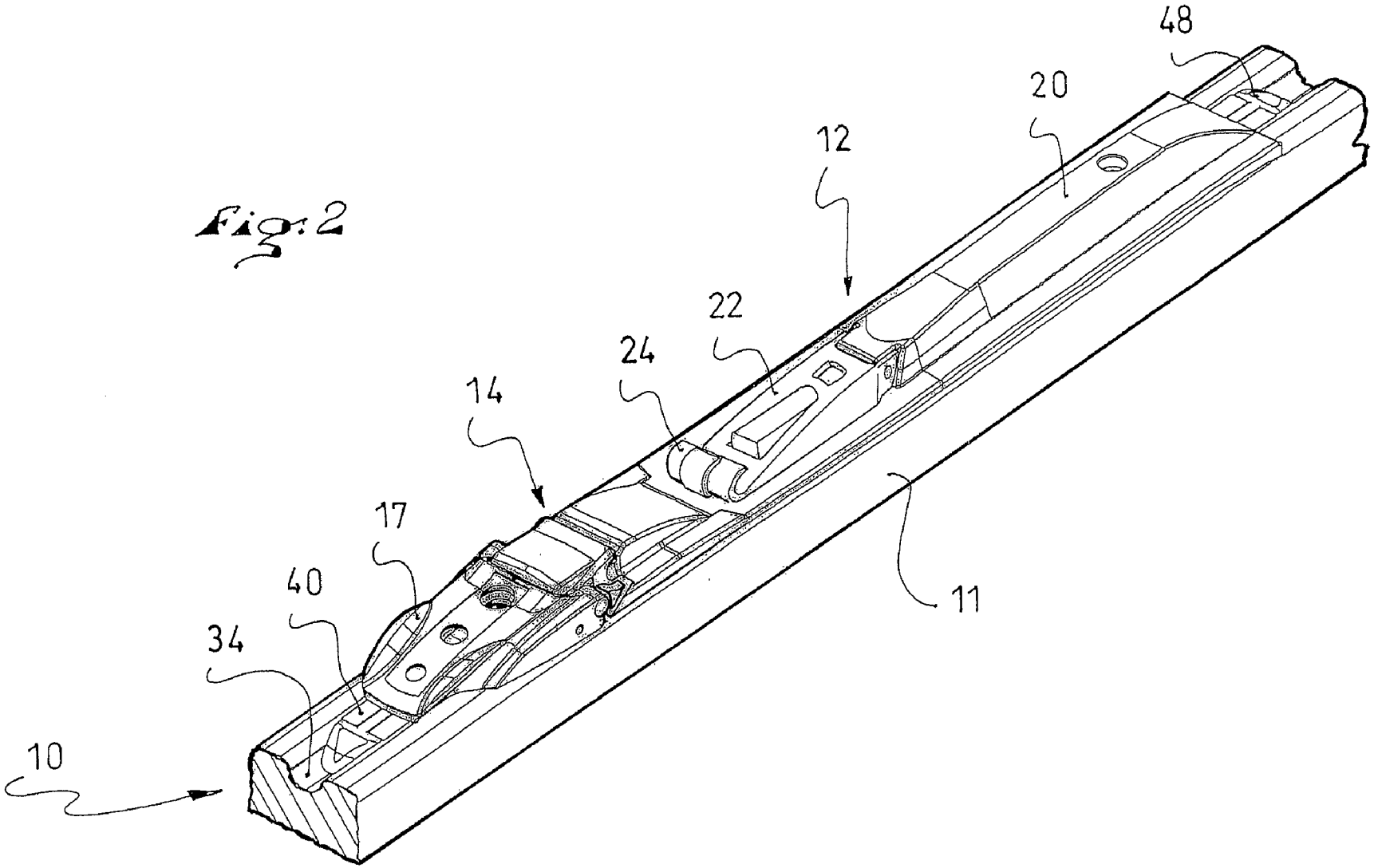
FIG. 2 is a perspective view of the assembly of FIG. 1, when in use.

In the examples shown, for example in FIG. 2, the binding device 12 is adapted to ensure the binding of a cross-country ski boot has two-part connectors.

The binding device 12 includes a base 26, or main body, which can be made in one or several parts, and on which, for example, a locking mechanism 14 and an elastic return mechanism (possibly a mere elastic bumper) are mounted. In the illustrated embodiment, the base 26 is made in one piece, but could alternatively have a rear portion (which would also form, for example, the rear portion of a guiding rib/ridge 20) and a front portion which would bear the locking mechanism. The main body 26 overall has a substantially plate-shaped lower portion extending over the length of the binding device and over a width close to the conventional width of the ski onto which it is to be attached. As can be seen, this lower, plate-shaped portion defines, on each side of the guiding ridge 20, lateral steps on which the boot is adapted to be supported when the skier exerts a downward pressure. In cross-country skiing, while the skier uses the classic technique or the skating technique, such a phase occurs especially when the skier thrusts himself/herself forward while supported on the ski.

For the purpose of ensuring its binding to the device 12, the boot (not shown in the drawings) has two connectors, such as pins or axles, that are positioned flush with sole of the boot, or at least otherwise accessible for connection to the binding device. Boots provided with this type of connection rod arrangement are disclosed in the patent documents EP-913102 and EP-913103, as well as in U.S. Pat. No. 6,289,610 and U.S. Pat. No. 6,374,517, the disclosures of the latter two documents being hereby incorporated by reference thereto in their entireties. These documents, disclose connectors for a boot in the form of two cylindrical members, for example, which extend across a longitudinal groove provided in the lower surface of the sole. The front connector is arranged, for example, in the vicinity of the front end of the sole, and the rear connector is rearwardly offset by a predetermined distance, so as to be arranged in the area of, or forward of, a zone of the boot corresponding to the metatarsophalangeal bending zone of the skier's foot. This arrangement of the connecting zones is particularly advantageous in cross-country skiing because it makes it possible, when using a boot having a flexible sole, to maintain a boot flexion corresponding to that of the foot. However, the invention could also be implemented with connecting members having a different structure or configuration, such as, for example, connectors with non-circular cross-sections, hooks, anchoring members formed directly in the material of the sole, such as grooves formed therewithin, etc.

Figure 3:
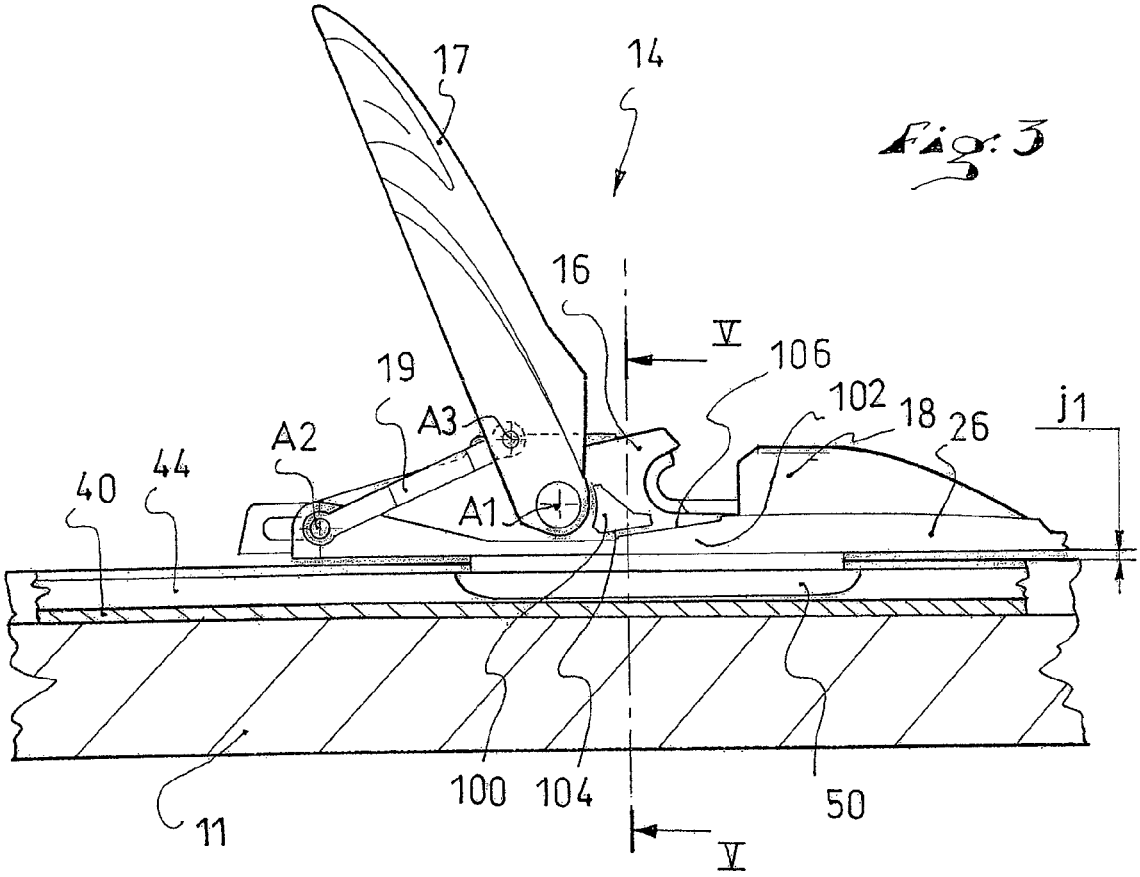
FIGS. 3 and 4 are partial, longitudinal cross-sectional, schematic views of the front portion of the assembly of FIG. 2, the locking mechanism of which is shown in the opening position and in the closing position, respectively.
Figure 4:
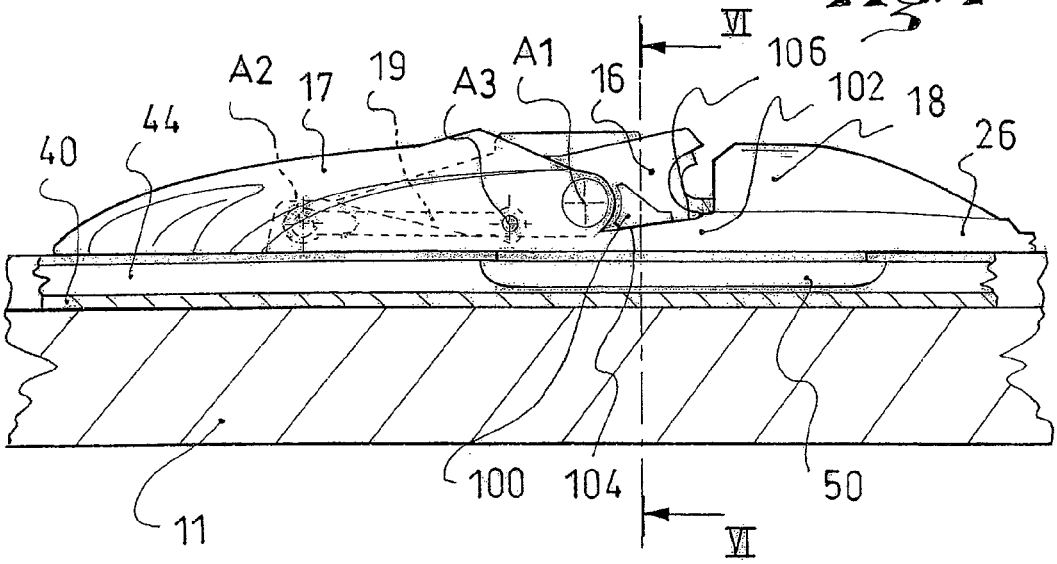

In a known manner, the front connector is adapted to cooperate with a locking mechanism 14, such as that shown particularly in FIGS. 3 and 4. The operating principle of the locking mechanism 14 is well-known in the art (such as, for example, those of the mechanisms marked by the assignee of the instant application, Salomon S.A., under the name "SNS Pilot"). It includes a movable hook-shaped jaw 16 and a transverse edge 18 of the base 26, forming a fixed jaw for rotatably locking the boot onto the sports apparatus, i.e., onto the ski 11. The movable jaw 16 is mounted on the base 26 of the device, so as to be able to longitudinally slide between a forward open position, shown in FIG. 3, and a rearward closed position, shown in FIG. 4. The displacement of the movable jaw 16 is controlled by a manipulable member in the form of a lever 17. More specifically, the lever 17 is articulated by a rear end on the movable jaw 16 about a transverse axis A1. The mechanism includes at least one connecting rod 19, which is articulated at a front end on the base 26 about a transverse axis A2. The connecting rod is also articulated on the lever 17 about an axis A3, which is arranged in the vicinity of the axis A1, but forward thereof.

With this arrangement, when the skier lifts up the front end of the lever 17, the lever pivots about its axis A1, but due to the presence of the connecting rod 19, the front end of which is connected to the fixed base 26, the lever also causes the movable jaw 16 to move forward toward the open position. Conversely, when the front end of the lever 17 is moved down, the lever 17 causes the movable jaw 16 to move rearward to its closed position. Advantageously, just before reaching its closed position, the mechanism switches through a configuration such that the axis A3 passes through the plane defined by the axes A1 and A2, and below such plane, so that, in the locking position, the mechanism is blocked by a toggle-lever effect, i.e., an over-center effect. In this way, regardless of the forces exerted on the movable jaw, such forces cannot cause the locking mechanism 14 to open. The locking mechanism, therefore, has a first mechanism for transforming movement, which transforms the composite movement of the manipulable lever 17 into a longitudinal translation of the movable jaw 16.

Once locked between the two jaws 16, 18 of the locking mechanism, the front connecting member of the boot can freely pivot inside the jaw, thus allowing for an articulated fastening of the front end of the boot relative to the ski.

The rear connecting member of the boot is adapted to enable the boot to be connected to an elastic return system integrated to the guiding ridge 20 of the device. Such an elastic return system can be constructed, for example, in the manner disclosed in the documents EP-768103 and U.S. Pat. No. 6,017,050, both commonly owned herewith by Salomon S.A., the disclosure of the latter of which is hereby incorporated by reference thereto in its entirety. Thus, it comprises a connecting rod 22 having a hook-shaped front end 24 (adapted to be hooked onto the rear connector of the boot), and a rear end connected to the base so as to be able to longitudinally slide and pivot about a transverse axis. An elastic return means, such as a spring, biases the rod 22 back in the resting position shown in FIG. 2. In this way, when the heel of the boot is lifted, by pivoting the boot about the boot's front connector, the rod 22, fastened to the boot's rear connector, can follow the upward and forward movement of the boot's rear connector, while exerting a return force on the rear connector, which tends to bring the sole of the boot toward the upper surface of the ski 11.

The invention can also be implemented with other binding devices, for example, with a binding device of the type disclosed in the documents EP-1440713 and U.S. Pat. No. 6,964,428, or any of those disclosed in the documents mentioned in the background, above. Thus, the invention can easily be implemented with a device having, at the front, an elastic bumper against which the front end of the boot is supported when the heel is lifted, as, for example, in the systems sold by Salomon S.A. under the name "SNS Profil". In this latter case, the boot can then have merely a single connector.

Figure 7:
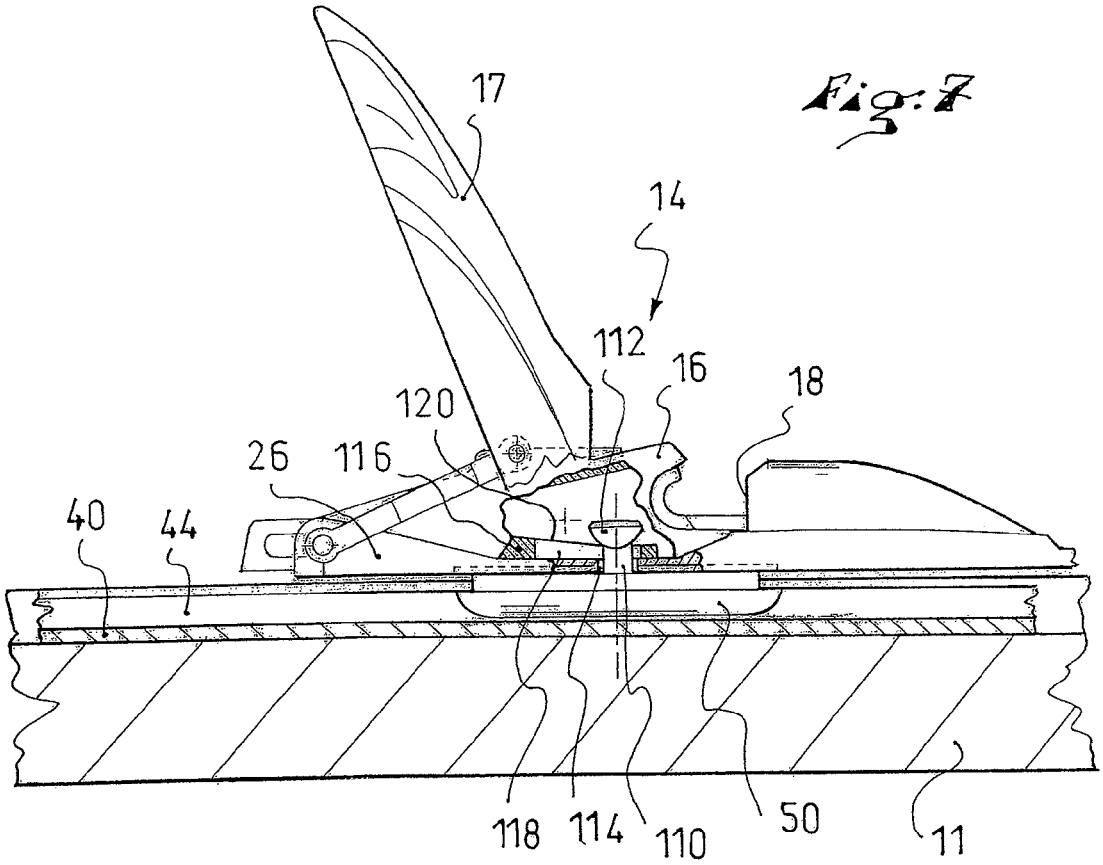
FIGS. 7 and 8 are similar views to those of FIGS. 3 and 4, showing a second embodiment of the invention.

In the two first embodiments shown in FIGS. 1 to 6 and in FIG. 7, respectively, the assembly comprises a ski 11 of the cross-country ski type (only the central portion of which is shown), the upper surface of which has a non-planar surface. In this case, the upper surface 32 has a hollow central recess 34, which extends longitudinally over a substantial portion of the length of the ski 11. More particularly, the recess 34 extends along the central zone of the ski, which is adapted to receive a binding device. In this case, this recess has a substantially U-shaped cross section, vertically upwardly open. In a cross-sectional view, the recess 34 is transversely framed on each side by lateral portions 36 of the upper surface of the ski, which are arranged above the level of the ski upper surface in the recess 34. Each of the lateral portions 36 is connected to the recess 34 by a rounded edge and is connected to one of the lateral surfaces 38 of the ski by another rounded edge, but each has a substantially planar portion between the rounded edges.

In the illustrated example, the recess 34 of the ski 11 has a particular shape created directly during the manufacture of the ski, which causes the upper layer of the ski (comprising, for example, from the inner portion to the outer portion, a resin-coated fiber reinforcement layer, a decorative layer, and an outer protective layer) to extend at the bottom of the recess 34 as well as in the lateral portions 36 of the upper surface 32 of the ski.

According to the invention, the assembly also includes a central slide 40 to anchor the binding device 12 to the ski.

In the first two embodiments of the invention, the central slide 40 is in the form of a longitudinal element adapted to be received and fixed within the recess 34 of the ski. In the example shown, the slide 40 is fixed in the recess by gluing or welding. In this case, it is advantageous that the slide has a lower contact surface 42, which is complementary to the upper ski surface in the recess 34 so as to guarantee a maximum contact surface. However, in an alternative configuration, the slide 40 could be fixed to the ski 11 by screws, in which case the lower surface 42 of the slide 40 could have a different structure than that of the recess 34, provided, however, that the slide 40 is precisely and stably positioned with respect to the ski. In other alternative embodiments, the slide could be fixed to the ski by fastening means previously implanted in the ski, for example during its manufacture. Such fastening means could be connected, for example, to the core of the ski or only to the upper surface of the ski. The slide could also be directly integrated to the ski during the manufacture of the ski. However, the slide could be more easily fixed against the outer layer of the upper surface of the ski during or after the manufacture of the ski.

The slide 40 has a longitudinal extending groove 44, or recess, which upwardly opens to an upper surface 46 of the slide, and has a cross-sectional shape having a lower portion and an upper portion. The maximum transverse width of the lower portion of the groove 44 is greater than that of the upper portion, which opens out onto the upper surface. The lower portion has a substantially semi-circular profile, whereas the upper portion is a simple groove with parallel vertical sides. The groove 44 thus has, in transverse section, a general shape similar to that of an upside-down keyhole. The slide 40 is entirely received within the recess 34, so that its width and height are less than or equal to the corresponding dimensions of the recess 34. The slide 40 thus has a smaller width than that of the ski in its central zone. In practice, the slide can have a width on the order of 10 to 25 mm, for a height on the order of 8 to 20 mm.

In the example shown, the recess 34 has, in transverse section, a constant shape over the entire length of the ski in which the slide is to be implanted. This way, the lower surface 42 of the slide 40, as well as the groove 44, can also have a constant shape over the entire length of the slide. In this case, the slide can be shaped as an extruded profile element and cut to the desired length, which is a particularly cost-efficient method of manufacture. However, the slide 40 could also be made by molding, or any other appropriate method of manufacture.

In the embodiment shown, the slide 40 is shaped as an extruded profiled element having finished ends 48 at each end of the slide.

To ensure its anchoring to the ski, the binding device 12 includes anchoring elements 50, 52, 56, which are adapted to cooperate with the slide 40.

In the example shown, each one of these anchoring elements comprises a rail element adapted to be slidably engaged in the groove 44 of the slide by being generally immobilized in all directions except in longitudinal translation. In this example, the rail elements have, in transverse cross-section, a profile similar to that of the groove 44. They could have a different profile, so as to be in contact with only certain portions of the walls defining the groove. In the example shown, the rail elements have a length on the order of 20 to 40 mm.

Each rail element is connected to at least one piece of the binding device.

Figure 1:
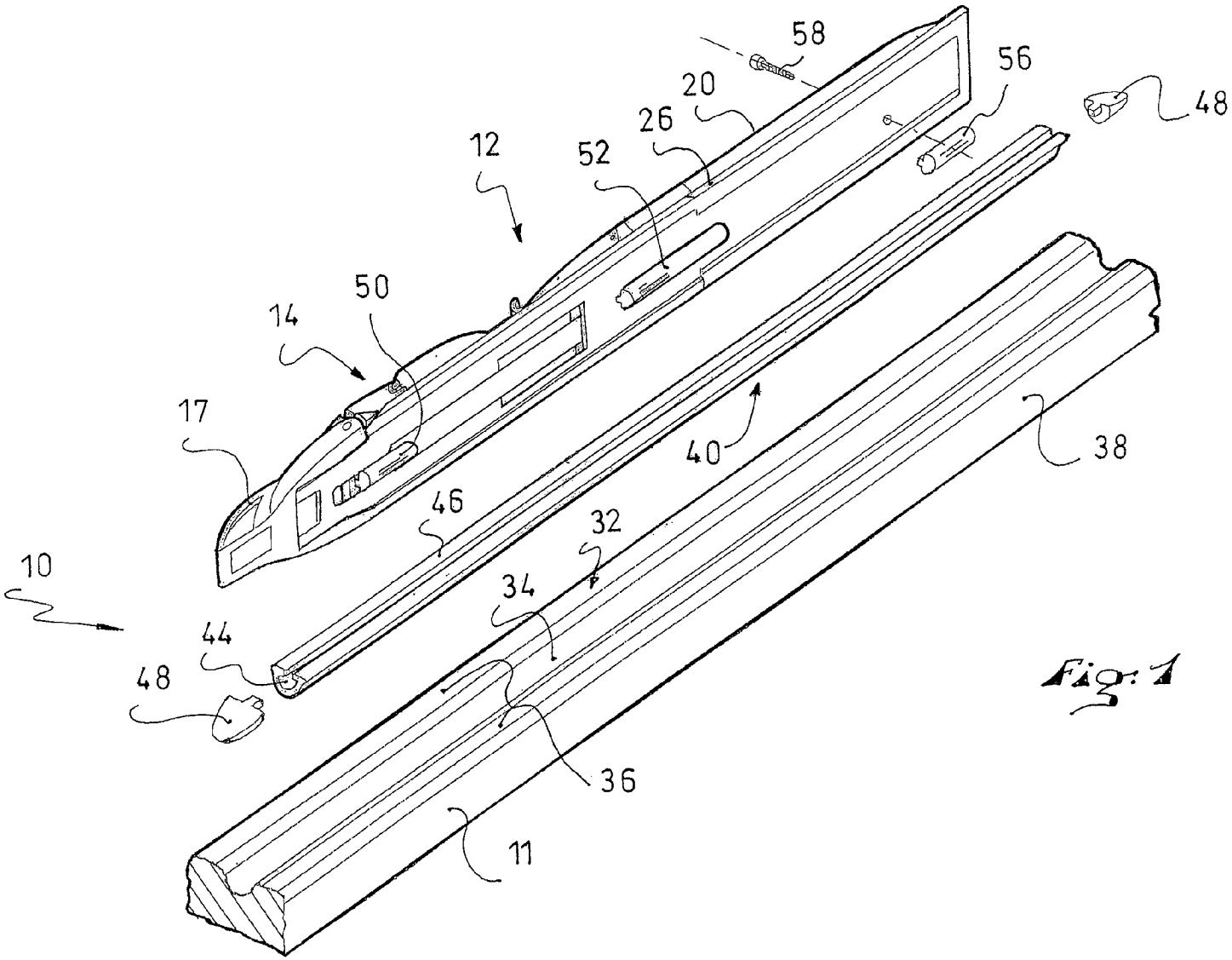
FIG. 1 is a schematic exploded perspective view of a first embodiment of an assembly according to the invention.

FIG. 1 shows, for example, that the central rail element 52 is simply a downward extension of the base 26 of the binding. The rail element 52, in the present case, is unitary with the base, but could also be a separate piece fixed by any known means (such as having been glued or welded in place, or secured in place with screws or by means of a nesting arrangement, etc.).

Conversely, as shown in the drawings, the rear rail element 56 is not fixed with respect to the binding device 12. The rear rail element 56 is provided as a part of a screw-nut portion, whereby the rear portion of the base 26 bears a screw 58 having a vertical axis, the upper head of which takes downward vertical support against the lower surface of a housing of the base 26. The screw 58 extends through this lower surface across an appropriate hole, and its lower end is screwed inside the screw-nut portion of the rear rail element 56 to form a means for downwardly tightening the binding device. Indeed, the rail element 56 when engaged in the groove 44 of the slide 40 can move neither upwardly/vertically, nor in rotation. This way, turning the screw 58 into the screw-nut portion of the rail element 56 causes a downward vertical movement of the screw 58, the head of which drives the base 26 along.

In the illustrated embodiment, the rear rail element 56 is made in the form of a portion of a tightening mechanism, whereas the central rail element 52 is only used for guiding and vertically retaining the binding device 12 on the ski 11. Providing for the front rail element 50 to be associated with a tightening mechanism is particularly useful to guarantee that the binding device 12 is optimally flattened against the ski 12.

This tightening mechanism could be designed similarly to the one just described in reference with the rear rail element 56.

However, according to one aspect of the invention, the anchoring device of the binding device comprises a tightening mechanism, which is actuated by movement of the manipulable member 17 from the open position to the closed position, and which enables the functional clearances in the vertical direction between the binding device and the ski or the slide to be eliminated. That is, the same movement of the manipulate member 17, i.e., a common movement of the manipulate member 17, accomplishes both movement of the boot-locking mechanism and movement of the binding-tightening mechanism from their respective non-use positions to their use positions for skiing.

In the first embodiment shown in FIGS. 1 to 6, the front rail element 50 is affixed to the movable jaw 16 and, therefore, follows the longitudinal movements of the jaw 16. The front rail element 50, therefore, can be made in one piece with the movable jaw 16, or as a separate piece. The rail element 50 thus extends beneath the device 12, projecting through a window of the base 26. As can be seen in FIG. 4 e.g., the rail element 50 extends directly vertically beneath the jaw 16 of the binding device 12, particularly in the closed position of the boot-locking mechanism of the binding device, i.e., in a "use" position of the mechanism with the boot held in the binding device during skiing.

Furthermore, a movement transformation mechanism is provided to cause a relative displacement along the vertical direction between the base 26 of the device and the anchoring piece constituted by the rail element 50.

In this first example, complementary ramps 100, 102 have therefore been provided on the movable jaw 16 and on the base 26, respectively. The ramp 100 of the movable jaw 16 comprises an active surface 104 facing downward and the ramp 102 of the base 26 comprises an active surface facing upward, both surfaces 104, 106 being upwardly inclined front to rear (i.e., upwardly inclined from left to right in FIGS. 3 and 4). When the lever 17 is caused to move toward its closed position (i.e., from the position of FIG. 3 to the position of FIG. 4), thus causing the movable jaw 16 to move rearwardly, the lever 17 causes, at the end of travel of the movable jaw 16, that is, as the movable jaw is moved closer to its closed position, the active surfaces 104, 106 of the ramps 100, 102 come into engagement. Once contact has been established between the surfaces of the ramps, the closing movement of the movable jaw 16 continues until it is in its closed position. During this latter portion of movement of the jaw 16, the ramps 100, 102 cooperate to cause a relative vertical displacement of the anchoring piece, i.e., the rail element 50 (which, in this case, is supported by the movable jaw 16) and of the base 26. Considering the position and the orientation of the active surfaces 104, 106 of the ramps 100, 102, this relative displacement causes movement toward the bottom of the base 26, and possibly a displacement toward the top of the movable jaw 16.

The movement transformation mechanism formed by the ramps 100, 102 is combined with the movement transformation mechanism comprised of the lever 17, the jaw 16, and the connecting rod 19 of the locking mechanism, so that it is actually the movement of the lever 17 that controls the vertical relative displacement of the anchoring piece 50 with respect to the base 26.

Figure 5:
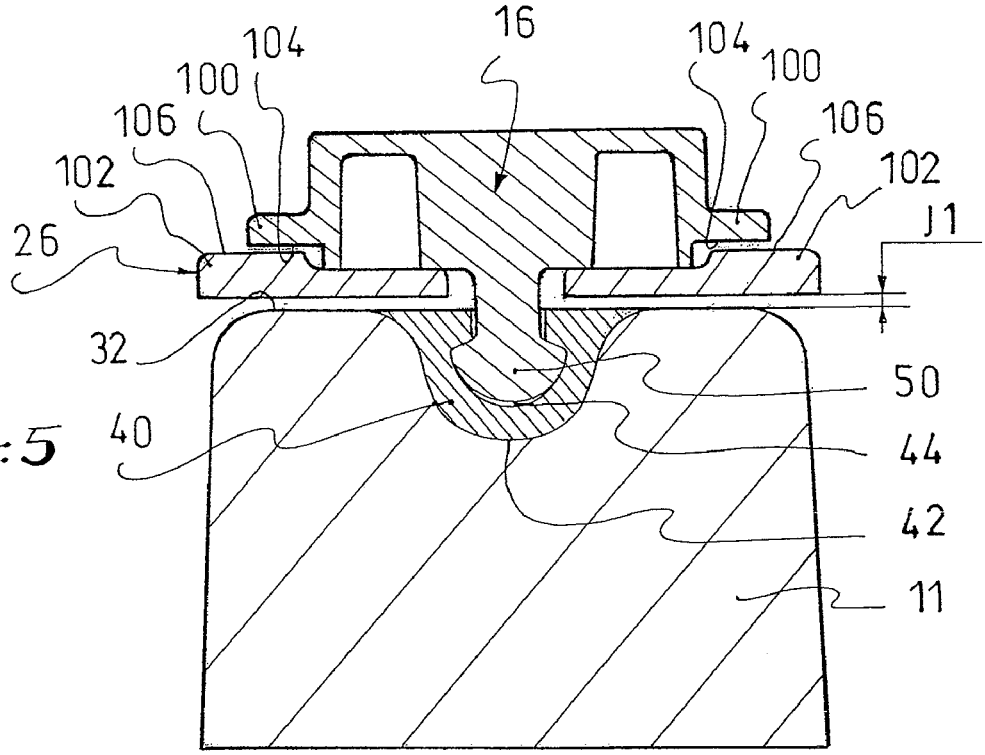
FIGS. 5 and 6 are cross-sectional transverse schematic views along the lines V-V and VI-VI of FIGS. 3 and 4, respectively.
Figure 6:
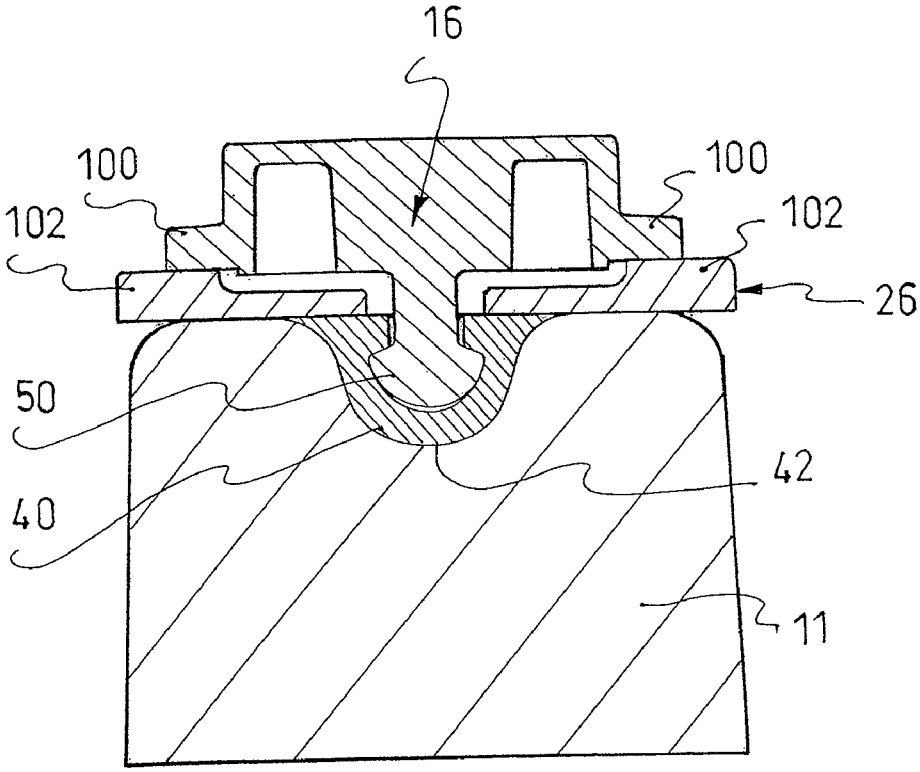

FIGS. 3 and 5 show a functional clearance "j1" between the base 26 and the upper surface 32 of the ski. Such a clearance is necessary to enable the binding device to engage in the slide. However, there are other functional clearances in such an arrangement. Thus, for the rail element 50 to be able to engage in the groove 44, despite their very similar shapes, a functional clearance must be provided between the dimensions of the rail element 50 and those of the groove 44. Similarly, as the movable jaw 16 is movably mounted on the base 26, a clearance must be provided between the two elements. All of these functional clearances are not shown in the schematic drawings, primarily because they are individually relatively small, for example on the order of a tenth of a millimeter. However, because they add on to one another, a very substantial overall play between the boot and the ski can thus be created.

With the tightening mechanism described above, all of the functional clearances are eliminated, at least in the vertical direction. Thus, the rail element 50 is first flattened upward in the groove 44; the clearance between the movable jaw and the base is naturally cancelled by the forced contact of the ramps 100, 102 as the base, flattened downward, takes support, for example, against the upper surface of the ski.

This tightening mechanism is particularly advantageous in that it does not require additional parts and that it is automatically implemented each time the locking mechanism is driven toward its closed position, therefore systematically each time the device is used. Furthermore, this tightening mechanism acts directly in the locking zone in which the boot is bound to the binding device. Indeed, with this embodiment, the anchoring piece 50 is directly connected to the main piece for locking the boot, that is, the movable, hook-shaped jaw 16. Flattening the base against the ski in the tightened position of the binding-tightening mechanism, i.e., in the "use" position thereof, provides the device with maximum lateral stability.

In an alternative embodiment, the orientation of the active surfaces of the ramps could be simply reversed, whereby the anchoring piece 50 could be connected to the base rather than to the movable jaw, and thus have the movable jaw flattened downward by the tightening mechanism.

According to an aspect of the invention, the assembly is designed to allow the binding device 12 not only to be mounted on the slide, as in the prior art, but also to be tightened when in support, for example, against the upper surface 32 of the ski or against the slide 40. In the first case, this characteristic eliminates any vertical play between the binding device 12 and the ski 11, so that any unwanted movement while skiing is avoided.

In an optimum mode, the assembly is designed so that the tightening mechanism causes the binding device 12 to first come and take support on the ski 11, then on the slide 40. Making the base first take support on the lateral portions 36 of the ski upper surface 32 guarantees a maximum contact width between the binding device and the ski as well as the lack of play between those two elements, the lateral portions 36 then forming support zones arranged transversely on both sides of the slide 40. Furthermore, allowing for the base to slightly change shape and also take support against the slide 40, after the tightening mechanism is actuated, the uplift forces exerted by the tightening mechanism on the slide 40 are eliminated.

In the illustrated example, three distinct, short-length rail elements have been utilized, which especially limits friction between the rail elements and the groove 44 of the slide when the device 12 engages on the slide 40. Indeed, in the example shown in the drawings, one of the elements, front or rear, must be engaged by one of the ends, front or rear, of the groove 44 of the slide 40. The device must then be engaged over the entire length separating the two end rail elements.

Alternatively, the slide 40 could comprise three windows, which would allow vertically engaging the rail elements in the groove thus opened, then longitudinally shifting the device to engage the rail elements in the non-open portions of the groove so as to vertically retain them. Such an alternative would allow not having to slide the device 12 over its entire length in the slide 40, which can be difficult when the ski is slightly curved, as such curvature can deform the slide.

Figure 8:
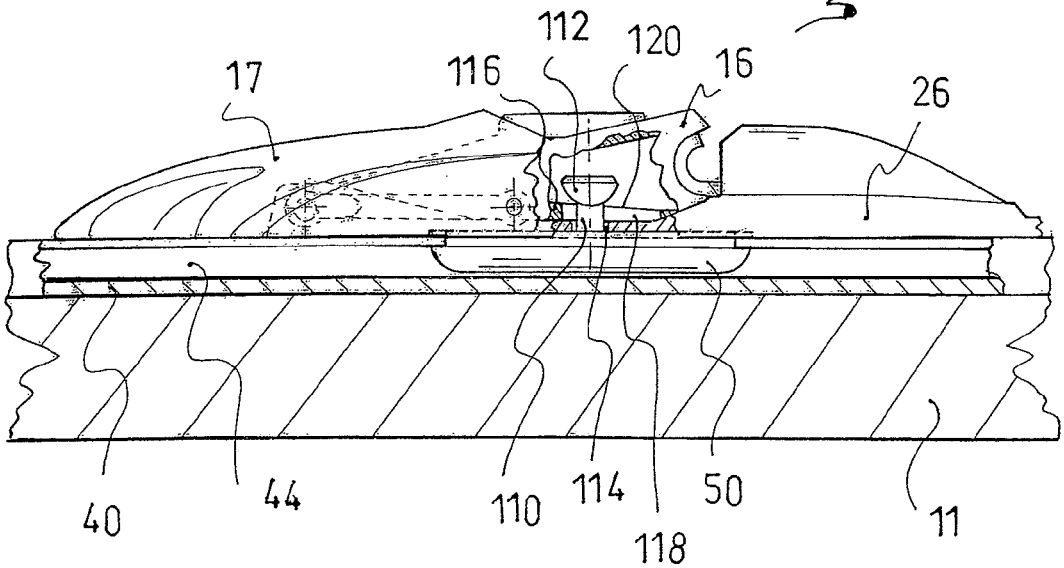

FIGS. 7 and 8 show an alternative embodiment of the tightening mechanism, which can be applied to the device 12 and to the slide 40 described in reference to the first embodiment hereinabove described.

In this embodiment, the anchoring piece 50 is no longer entirely fixed to the movable jaw 16. Instead, it is made as an independent piece, which is only immobilized longitudinally and transversely with respect to the base 26, while being vertically movable with respect to the latter. The anchoring piece 50 is therefore constituted of a rail element that is identical to those described in reference to the previous embodiment, but is provided with a rod 110, which vertically extends toward the top, the rod 110 having an hemispherical head 112 at its upper end.

The rod 110 extends through an opening 114 of the base 26, the design of which is such that the opening 114 allows the anchoring piece 50 to be longitudinally blocked with respect to the base 26. However, the rod 110 remains free along a vertical direction with respect to the base 26. The rod 110 also extends through a slot 118 arranged in a lower wall 116 of the movable jaw. The slot 118 is oblong in the longitudinal direction and its length is such that the rod of the anchoring piece 50 (immobilized longitudinally by the base 26) cannot hinder the displacement of the movable jaw 16 between its opening and closing positions. Conversely, the hemispherical head 112 of the anchoring piece takes support against an upper surface 120 of the lower wall 116 of the movable jaw. This upper surface, turned upward, has the shape of a ramp inclined downward, from front to rear. The angle of inclination of the ramp is low (and exaggerated in the drawings).

When the skier manipulates the locking mechanism toward its closed position, causing the movable jaw to move back toward its closing position, the ramp-shaped upper surface 120 of the jaw 16, as a result, moves beneath the hemispherical head 112 of the anchoring piece. Considering the slope of the ramp 120, this translates into a vertical relative movement between the anchoring piece 50 and the jaw 16, the anchoring piece 50 being lifted up and the movable jaw being flattened downward. Because the anchoring piece is vertically retained in the slide 40, a tightening force toward the bottom of the movable jaw presses the base 26 against the ski and/or the slide. The hemispherical head 112 and the ramp 120 form a means for transforming the horizontal movement of the jaw 16.

Figure 9:
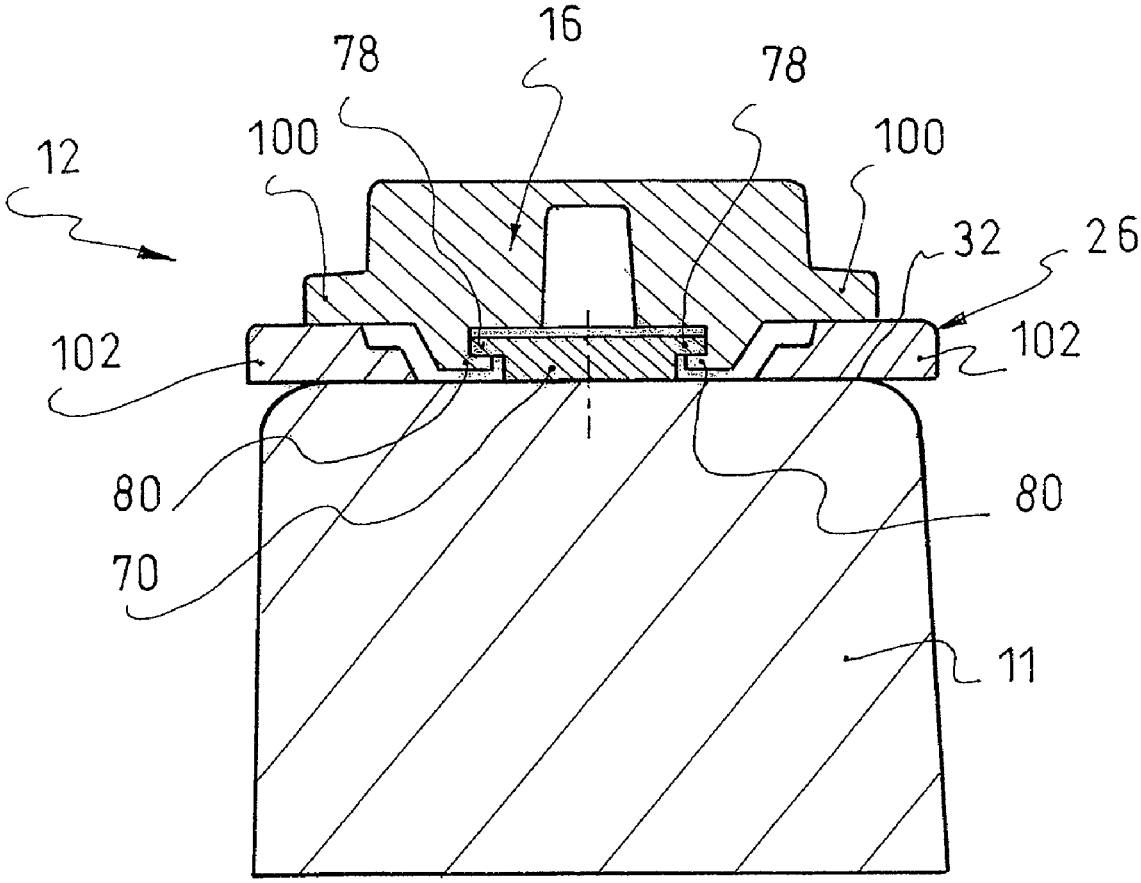
FIG. 9 is a view similar to that of FIG. 6, showing a third embodiment of the invention.

A third embodiment of the invention is very schematically shown in FIG. 9. In this third embodiment, the invention is applied to an assembly comprising a cross-country ski having a flat upper surface 32. As clearly shown in the drawings, the binding device 12 can be essentially identical to that described in reference to the first embodiment, except for the means for anchoring the device on the ski. Indeed, the anchoring of the device is carried out by means of a slide 70, which cannot be integrated within a recess of the ski, since the ski has no recess. As a result, the slide 70 is raised on the upper surface 32 of the ski. The example shown has a T-shaped profile with a lower portion whose lower surface takes support on the upper surface 32 of the ski 11. The width of the upper portion of the slide 70 is greater than that of the lower portion, so as to overlap transversely outward on both sides of this lower portion. Thus, on each side of the slide 70, overhanging edges 78 transversely extend outward with respect to the lateral surfaces of the lower portion of the slide 70, above the upper surface of the ski.

The width of the lower portion, in a particular form of this embodiment, is on the order of half the width of the ski in the zone for binding the device 12. For a cross-country ski assembly, this lower portion can thus have a width on the order of 20 mm. The width of the upper portion is several millimeters, for example 5 or 6 mm, greater than that of the lower portion. As a result, the overhanging edges 78 measure only a few millimeters, for example 2 or 3 mm. The lower portion and the upper portion each measure, for example, between 2 and 5 mm.

In the example shown, the slide 70 is made by having been molded from a plastic material. Such plastic material can optionally be reinforced with fibers such as glass fibers. However, other methods of construction are contemplated according to the invention. For example, the slide 70 could be made out of other types of material, such as metal or composite materials, etc. Similarly, the slide could be made of several parts, the upper and the lower parts, for example, being made as two distinct portions. Similarly, the T-shaped profile of the slide could be replaced by a V-shaped profile (dovetail type), or a W-shaped profile, or other shape.

For this reason, the anchoring pieces of the device 12 can be made in the form of complementary rails 80 which, in this embodiment closely derived from the first embodiment, extend longitudinally under the movable jaw 12. These rails 80 have an L-shaped profile, and each of them has a transverse edge turned inward, which is adapted to engage under the overhanging edges 78 of the slide 70. The transverse spacing between the two edges vis-à-vis the rails 80 is substantially equivalent to the width of the lower portion of the slide 70. Similarly, the edges are spaced from the lower surface of the device by a distance substantially equivalent to the thickness of the upper portion of the slide 70.

This third embodiment of the invention comprises, like the first embodiment, ramps 100, 102, which transform the movement controlled by the lever 17 into a relative displacement of the movable jaw with respect to the base, making it possible to press the latter against the ski and/or the slide.

In the previously described embodiments, the tightening mechanism, in addition to compensating for play, makes it possible to block the binding device 12 longitudinally in the corresponding slide 40, 70. The blocking is carried out by tightening, thus by friction. In this case, tightening is carried out between smooth surfaces, so that, over a certain adjustment range, the blocking can be carried out in an infinite number of positions, continuously over this adjustment range, or in any position within a continuous adjustment range.

Further, providing that tightening first brings the device 12 in support directly on the ski rather than on the slide, ensures optimal stability by means of a maximum transverse spacing of the supports, on the one hand, and a direct transmission of the support forces exerted by the skier on the device toward the ski, without the slide having any filtering or damping effect, on the other hand.

In the examples shown hereinabove, the slide is longitudinally made as a single piece, with a substantially constant cross section over its entire length. Alternatively, the slide can be made in several parts, such parts being either distinct or linked together by connecting portions not forming a slide. Alternatively, the sections can be limited to point sliding elements, longitudinally aligned and arranged to correspond to anchoring elements of the binding device. Such embodiments have the advantage of being lighter. They also prevent any longitudinal stiffening effect of the ski, which could be due to having the slide on the upper surface of the ski. Conversely, the stiffness due to the slide could be a useful characteristic for the optimal functioning of the assembly 10. In this regard, the previous embodiments provide for the slide to be entirely secured to the ski. However, if secured by means of screws, all but one of the screw locations can be provided to enable the slide to freely slide with respect to the ski. This type of assembly is well known in interface systems for alpine skiing, and limits the effects of stiffening the ski by means of the interface.

In the examples above, the tightening mechanism controlled by the lever 17 uses a double means for movement transformation. The movement of the lever is first transformed into movement of the movable jaw, then into a relative vertical displacement of the anchoring piece with respect to the base of the device. Alternatively, the tightening mechanism could be controlled directly by the lever, for example with a movement transformation mechanism in the form of a cam arranged about the axle A3.

Other movement transformation mechanisms, using eccentric systems, rack systems, etc., for example, are within the scope of the invention.

The invention claimed is:

1. An ski assembly comprising:

a ski having an upper surface;

a binding device adapted to retain a boot on the ski, the binding device adapted to be supported on the ski;

an anchoring device to anchor the binding device on the ski, the anchoring device comprising a slide;

the binding device comprising a base and a mechanism for locking the boot relative to the base, said mechanism comprising at least one movable member and a manipulable member operably connected to control movement of the movable member between an open position and a closed position;

the anchoring device comprising at least one mechanism for tightening the binding device with respect to the ski, said tightening mechanism causing the binding device to be tightened with respect to the ski, in a direction toward the ski, by movement of the manipulable member from said open position to said closed position.

2. An assembly according to claim 1, wherein:

the anchoring device further comprises an anchoring element;

the manipulable member is constructed and arranged to control a relative displacement between the base and the anchoring element, said anchoring element cooperating with said slide of the anchoring device.

3. An assembly according to claim 2, wherein:

the manipulable member is constructed and arranged to control said relative displacement by means of at least one movement transformation mechanism.

4. An assembly according to claim 3, wherein:

the movement transformation mechanism comprises at least one of the following: ramp, cam, rack, and an eccentric drive means.

5. An assembly according to claim 3, wherein:

the binding device comprises said movement transformation mechanism, said movement transformation mechanism acts between the movable member of the locking mechanism and the base of the binding device.

6. An assembly according to claim 2, wherein:

the anchoring element is fixed to the base.

7. An assembly according to claim 2, wherein:

the anchoring element is fixed to the movable member of the locking mechanism.

8. An assembly according to claim 3, wherein:

the anchoring element is connected to the base while being vertically movable with respect to the base; and the movement transformation mechanism acts between the movable member of the locking mechanism and the anchoring element.

9. An assembly according to claim 1, wherein:

the tightening mechanism is structured and arranged to allow the tightening of the binding device directly against the upper surface of the ski.

10. An assembly according to claim 1, wherein:

the tightening mechanism is structured and arranged to allow the tightening of the base of the binding device against a support zone, said support zone being transversely arranged on each of opposite sides of the slide.

11. An assembly according to claim 1, wherein:

the tightening mechanism is structured and arranged to tighten the binding device against the slide.

12. An assembly according to claim 1, wherein:

the anchoring slide is arranged in a recess of the upper surface of the ski.

13. An assembly according to claim 1, wherein:

the anchoring slide is raised on the upper surface of the ski.

14. An assembly according to claim 1, wherein:

the binding device comprises a guiding and vertical retaining mechanism, which cooperates with the slide to allow the binding device to be positioned on the upper surface of the ski.

15. An assembly according to claim 1, wherein:

the tightening mechanism of the binding device allows longitudinally blocking of the binding device with respect to the slide.

16. An assembly according to claim 1, wherein:

the slide has a constant cross-sectional shape along a length.

17. An assembly according to claim 16, wherein:

the slide is a sectioned profile having at least two sections.

18. An assembly according to claim 1, wherein:

the base of the binding device is not attached to the ski by means of screws extending into the ski.

19. An assembly according to claim 1, wherein:

the slide of the anchoring device is attached to the ski by having been glued or welded to the ski.

20. An ski assembly comprising:

a ski having an upper surface;

a binding device adapted to retain a boot on the ski, the binding device adapted to be supported on the ski;

an anchoring device to anchor the binding device on the ski, the anchoring device comprising a slide fixed against movement to the ski;

the binding device comprising a base and a mechanism for locking the boot relative to the base, said mechanism comprising at least one movable member and a manipulable member operably connected to control movement of the movable member between an open position and a closed position;

the anchoring device comprising at least one mechanism for tightening the binding device to the slide, thereby tightening the binding with respect to the ski, said tightening mechanism causing the binding device to be tightened with respect to the ski, in a direction toward the ski, by movement of the manipulable member from said open position to said closed position.

21. An assembly according to claim 20, wherein:

the anchoring device further comprises an anchoring element;

the manipulable member is constructed and arranged to control a relative displacement between the base of the binding device and the anchoring element, said anchoring element cooperating with said slide of the anchoring device to be selectively tightened and untightened to said slide.

22. An assembly according to claim 21, wherein:

the anchoring element is connected against removal from the base.

23. An assembly according to claim 21, wherein:

the tightening mechanism is structured and arranged to allow the tightening of the base of the binding device directly against the upper surface of the ski.

24. An assembly according to claim 20, wherein:

the base of the binding device is not attached to the ski by means of screws extending into the ski.

25. An assembly according to claim 20, wherein:

the slide of the anchoring device is attached to the ski by having been glued or welded to the ski.

26. A ski assembly comprising:

a binding device adapted to engage a boot to connect the boot to the ski;

the binding device comprising:

a base;

at least one downwardly extending rail element;

a boot-locking mechanism for locking the boot relative to the base, said boot-locking mechanism comprising:

at least one movable member;

a manipulable member operably connected to control movement of the movable member between an open position and a closed position, in said closed position said binding-locking mechanism being in a use position by which the boot is held in the binding device during skiing, and in said open position said binding-locking mechanism being a non-use position by which the boot is selectively removable from and insertable to the binding device;

an anchoring device to anchor the binding device to the ski, the anchoring device comprising:

a slide;

said downwardly extending rail element of the binding device being slidably engageable with said slide;

at least one binding-tightening mechanism for tightening the binding device to the ski, said manipulable member being operably connected to control movement of said rail element between a non-tightened position and a tightened position against longitudinal movement relative to the slide, said tightened position being a use position of the binding-tightening mechanism by which the base of the binding device is tightened to the ski during skiing, and said non-tightened position of said binding-tightening mechanism being a non-use position by which the base of the binding device is movable relative to the ski.

27. An assembly according to claim 26, wherein:

the manipulable member is constructed and arranged to control a relative displacement between the base and the rail element.

28. An assembly according to claim 27, wherein:

the rail element is connected to the base while being vertically movable with respect to the base.

29. An assembly according to claim 26, wherein:

the rail element is fixed to the movable member of the boot-locking mechanism.

30. An assembly according to claim 26, wherein:

the boot-locking mechanism includes a jaw for engaging a connector of the boot;

at least in the closed position of the binding device, the rail element is positioned directly beneath the jaw of the boot-locking mechanism.

31. An assembly according to claim 26, wherein:

the binding-tightening mechanism is structured and arranged to tighten the binding device against the slide.

32. An assembly according to claim 26, wherein:

said binding device is a cross-country binding device adapted to lock a front of the boot relative to the base, for an articulated fastening of the front end of the boot relative to the ski, allowing a heel of the boot to be raised and lowered relative to the ski in said use position of the boot-locking mechanism.

33. An assembly according to claim 26, further comprising:

said ski.

34. An assembly according to claim 33, wherein:

the binding-tightening mechanism is structured and arranged to allow the tightening of the binding device directly against the upper surface of the ski.

35. An assembly according to claim 33, wherein:

the binding-tightening mechanism is structured and arranged to allow the tightening of the base of the binding device against a support zone, said support zone being transversely arranged on each of opposite sides of the slide.

36. An assembly according to claim 33, wherein:

the slide is arranged in a recess within an upper surface of the ski.

37. An assembly according to claim 33, wherein:

the base of the binding device is not attached to the ski by means of screws extending into the ski.

38. An assembly according to claim 33, wherein:

the slide of the anchoring device to the ski by having been glued or welded to the ski.

39. An assembly according to claim 33, wherein:

said manipulable member is structured and arranged to accomplish both of the following by means of a common manipulation:

move said boot-locking mechanism from said non-use position to said use position of said boot-locking mechanism; and move said binding-tightening mechanism from said non-use position to said use position of said binding-tightening mechanism.

* * * * *